United States Patent [19]

Radke

[11] 3,934,910

[45] Jan. 27, 1976

[54] DOOR GUARD

[76] Inventor: Edward Radke, 1733 S. Carter, Midland, Mich. 48640

[22] Filed: Dec. 12, 1974

[21] Appl. No.: 531,979

[52] U.S. Cl. ..... 292/346
[51] Int. Cl.[2] ..... E05C 1/00
[58] Field of Search ..... 292/346, 247, 337; 70/416, 70/418

[56] References Cited

UNITED STATES PATENTS

| | | | |
|---|---|---|---|
| 1,092,946 | 4/1914 | Page | 292/346 |
| 3,673,605 | 6/1972 | Allenbaugh | 292/346 |
| 3,764,173 | 10/1973 | Griffith | 292/346 |

*Primary Examiner*—Richard E. Moore
*Attorney, Agent, or Firm*—John J. Swartz

[57] ABSTRACT

A lock guard attachment for a door mounted lock having a movable latch bolt, the guard attachment comprising: a generally U-shaped channel, adapted to fit over a vertical edge portion of the door, having a base provided with a latch bolt receiving opening therein and opposed flanges on the base for bearing against opposite sides of the door to inhibit access of the bolt to burglars.

1 Claim, 4 Drawing Figures

DOOR GUARD

BACKGROUND OF THE INVENTION

Existing door locking devices are generally inadequate to protect homes or the business establishments from being easily burglarized. Conventional door locking apparatus comprises a bolt movable between an extended, door latching position and a retracted position. Holes or openings are generally cut in the door to receive the movable bolt and door knob mechanism for moving the bolt as usual. With most wood doors, there is very little wood door material remaining on either side of the bolt. A burglar can easily gain access to the inside of a building protected by such lock apparatus, by inserting a pry bar between the door jamb and the door and prying outwardly or else merely inwardly directed force on the door from the outside to apply pressure to the bolt. Since relatively little wood material remains on either side of the bolt, the remaining door material adjacent to the bolt is easily ripped and torn.

Conventional door locking apparatus also comprises a light weight strike plate fastened via screws to a door jamb including an aperture for receiving the door locking bolt. When a burglar exerts force between the door and jamb, the light weight strike plate will frequently rip from the jamb.

Accordingly, it is an object of the present invention to provide a new and novel door attachment which will guard a door lock against unauthorized access by burglars.

It is another object of the present invention to provide a lock guard attachment for a door including a generally U-shaped channel which will fit over an edge portion of a door and has a bolt receiving opening therein for receiving a door latching bolt.

It is an object of the present invention to provide a U-shaped door lock guard of the type described in combination with two door locks having movable bolts receivable in apertures provided in the base of the guard and movable bolt actuating mechanism received in apertures provided in the flanges.

It is another object of the present invention to provide door locking apparatus of the type described including a strike plate having a door stop flange which extends inwardly to cover the space between a strike plate mounting door jamb and the door adjacent to the bolt and an oppositely disposed mounting flange which is fixed to the inside of the door jamb.

Other objects and advantages of the present invention will become apparent to those of ordinary skill and art as the description thereof precedes.

SUMMARY OF THE INVENTION

A one piece lock guard for a door mounting a door lock having a door locking bolt laterally movable between a projecting position laterally outwardly beyond one lateral edge of the door and a laterally inner position comprising an elongate channel, being U-shaped in section, having a base portion with an aperture therethrough receiving the bolt, and a pair of confronting flange portion bearing against the inner and outer sides of the door.

The present invention may more readily be understood by reference to the accompanying drawings in which.

Figure 1:
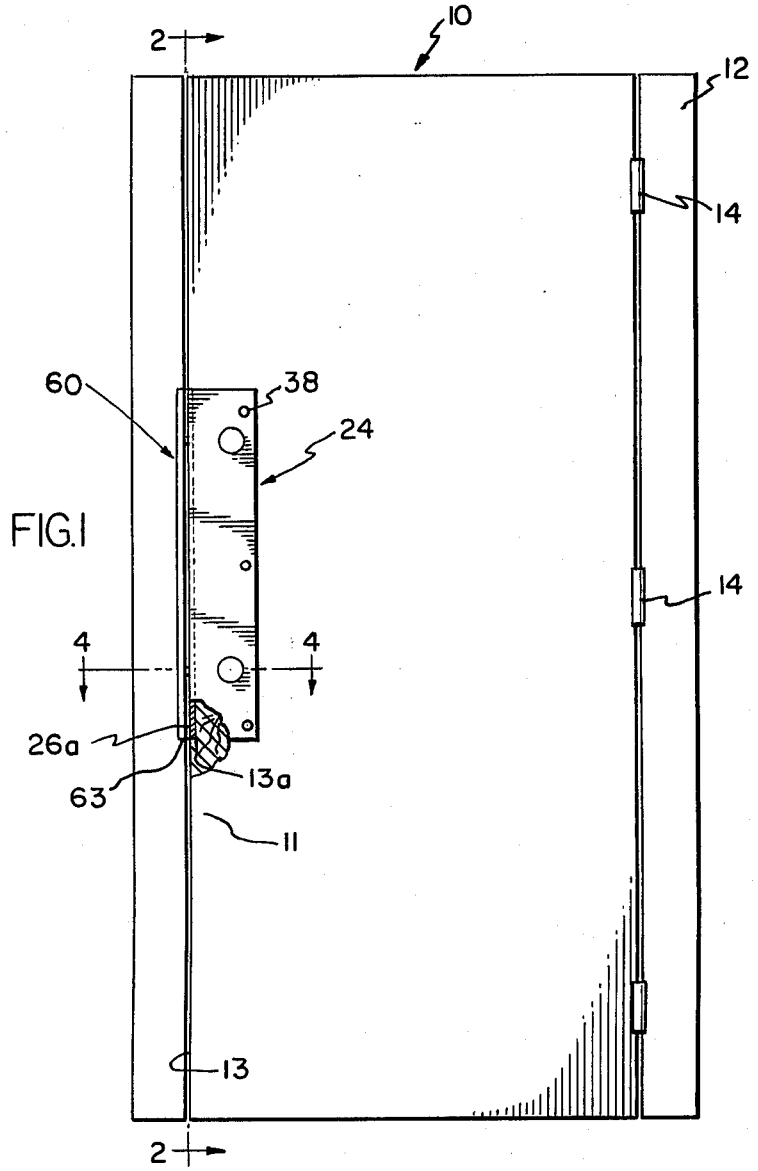
FIG. 1 is a front elevational view illustrating a door and door jamb mounting apparatus constructed according to the present invention.

Apparatus constructed according to the present invention is particularly adapted for use with a building door generally designated 10, swingably mounted on a door jamb, generally designated 12 via conventional hinges 14. Mounted on an unhinged side portion of the door 10 is a commercially available door latch assembly, generally designated 18, including a laterally extending latching bolt 20 movable in a suitable aperture **20*a* provided in the door 10, to and from a latching position, by axially aligned, inner and outer door knobs or handles 22 which are rotatably mounted on inner and outer sides 10*a* and 10*b* of the door 10, as usual. The latching bolt 20 includes an inclined cam face 20*b* for camming the bolt 20 to a position flush with the unhinged side 13 of the door 10 when the door is moving to the closed position in which latter position the bolt 20** is again permitted to move laterally outwardly to a door locking position.

A spring (not shown) is provided for biasing the bolt 20 outwardly to a latching position. A bolt lock is provided on the inner door knob for preventing retraction of the bolt 20 by rotation of the outer knob. The bolt can normally be pryed inwardly by a burglars pry bar against the force of the biasing spring even though the door is locked.

Figure 2:
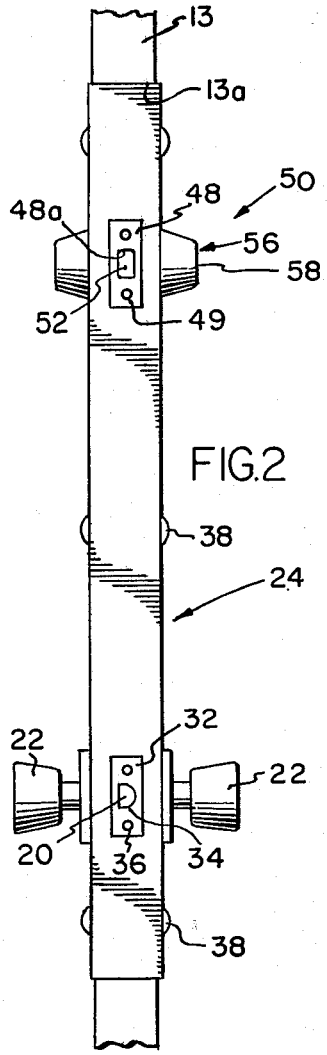
FIG. 2 is a sectional end view taken along the line 2—2 of FIG. 1.
Figure 3:
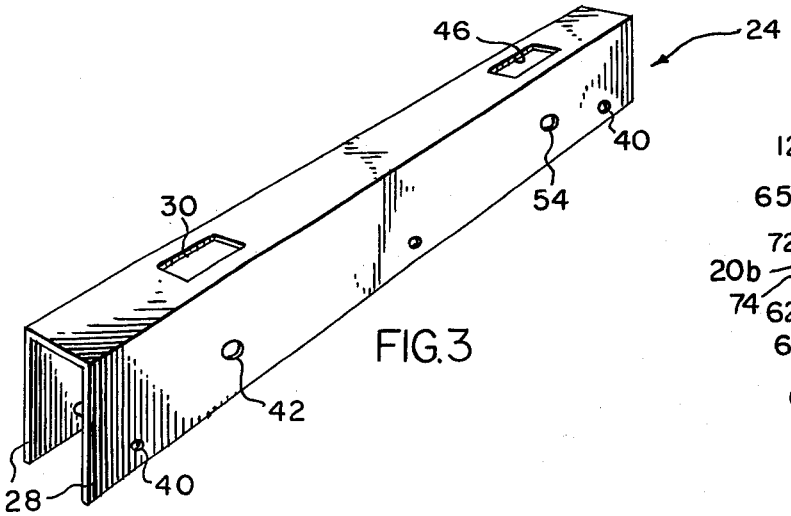
FIG. 3 is a perspective view of the lock guard attachment which fits over the free edge portion of the door.
Figure 4:
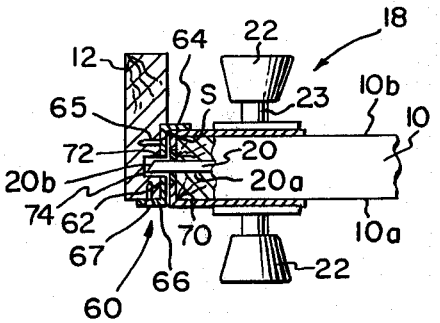
FIG. 4 is a sectional plan view, taken along the line 4—4 of FIG. 1.

A lock guard attachment constructed according to the present invention is generally designated 24 and comprises a one piece channel which is U-shaped in section and fits over a vertical edge portion 11 of the door 10 as illustrated in FIGS. 1, 2 and 4. The lock guard attachment 24 includes a base portion 26 adapted to bear against a vertical, lateral side surface 13 of the door 10 and a pair of opposed, confronting legs or flanges 28 which bear against the inner and outer door surfaces **10*a* and 10*b*. The base 26 includes an opening 30 which mounts a bolt plate 32 having a bolt receiving aperture 34 therethrough for receiving the latching bolt 20. The lateral side door surface 13 is recessed at 13*a* to receive the bolt plate 13 so that the laterally outer bolt plate surface 26*a* is flush with the surface 13*a* as is best illustrated in FIG. 1. The bolt plate 32 is also secured to the lateral door surface 13 via screws 36. The door guard attachment is fixed to the door surfaces 10*a* and 10*b* via screws 38 received in openings 40 provided in the flanges 28**.

The door knobs 22 are partially rotatable, as usual and include bolt actuating stems 23, extending generally transversely to the plane of the door, for actuating the bolt. The door guard flanges 28 including openings 42 which rotatably receive bolt actuating stems 23. The base 26 of the door guard attachment also includes a second opening 46, in vertically spaced relation with the opening 30, for receiving a second bolt plate 48 fixed to the recessed, lateral, door surface portion **13*a* via screws 49. Mounted on the door 10 in vertically spaced relation with the door latch assembly 18 is an auxiliary door latch assembly, generally designated 50, including a "dead" bolt 52 which is laterally movable in an opening 48***a* provided in the bolt plate 48 between a laterally outer, door latching position, and a retracted position substantially flush with the laterally outer surface 26a of the base 26. Openings 54 are provided in the door guard flanges 28 for receiving transversely extending, bolt actuating mechanism, generally designated 56, which includes a key receiving tumbler 58, that is disposed generally perpendicular to the plane of the door 10. A key may be inserted into the key receiving tumbler 58 and turned to move the bolt 52 between the extended and retracted positions. The door latch assembly 50 does not include door knobs or a spring biasing the bolt 52 outwardly and the bolt 52 may be extended and retracted only if the key is turned. This structure inhibits burglary since the bolt 50, which does not include a camming surface and biasing spring, is not easily cammed inwardly via a thin burglars plate.

The apparatus constructed according to the present invention also includes a strike plate, generally designated 60, including a vertical, generally planer, intermediate plate portion 62 which is received in a door jamb recess or slot 63 and held by screws 65. The intermediate plate portion 62 includes a pair of vertically spaced, bolt receiving apertures 72, aligned with a pair of aperture 74, provided in the door jamb 12, for receiving the latching bolts 20 and 52, when the door is in the closed position. The strike plate 60 includes a vertical door stop flange 64 extending transversely inwardly from the laterally outer side of the intermediate plate portion 62, and an oppositely extending, transverse mounting flange 66 overlying the inside of the door jamb 12. A plurality of screws 67 hold the mounting flange 66 to the jamb 12. The door stop flange 64 covers the space *s* between the confronting lateral side door surface 13 and the door jamb 12 adjacent to the bolt so that a burglar cannot pass a thing burglar's plate between the door jamb 12 and the door to engage the cam surface 20*b* of the bolt 20 to laterally move it to a retracted position inside the door. The elimination of a cam surface on the bolt 50 further inhibits a burglar from retracting the bolt. The mounting flange 66 provides greatly added strength which inhibits the removal of the plate assembly 60 from the door jamb 12. In the event that a burglar inserts a pry bar between the door stop flange 64 of the plate 60 and the outside door surface 10*a*, the inwardly directed force transmitted through the bolts 20 and 52 to the strike plate will neutralize the outwardly directed force exerted by the pry bar on the flange 64, thus the plate 60 will remain in position. The door plate 60, in conjunction with the bolts 20 and 52 provide an assembly which cannot be easily ripped out of the door jamb, thus the door effectively must be destroyed in order to gain access to the inside of the establishment. The door guard attachment 24 inhibits destruction of the door, however, since any force exerted transverse to the plane of the door 10 on the bolts 52 and 20 is transmitted via the stop plates 32 and 48 to the base portion 26. The transverse force transmitted to the base portion 26 is not borne by the remaining door portion 70 on opposite sides of the bolts 20 and 50 but rather is borne by the large flat surfaces of the flanges 28 which bear against the surfaces 10*a* and 10*b* over a relatively large area. The effect of the transverse force thus exerted by such a pry bar is greatly diminished.

If a burglar exerts a transverse force between the strike plate flange 64 and the outer flange 28 immediately adjacent thereto, the force transmitted to the bolts 20 and 50 by the strike plate 62 will be transmitted through the stop plate 32 to the flange 28 adjacent to flange 64 and will disburse much of the force over a substantially large area of the door 10.

Accordingly, the effect of the pry bar will be greatly diminished and the door will be secured.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the inventions or the scope of the appended claims.

What I claim is:

1. In combination:

a door having inner and outer sides and generally vertical lateral edges;

a door lock, mounted on said door including a door locking bolt laterally movable between a projecting position laterally outwardly beyond at least one lateral edge of said door and a laterally inner position; and rotatable bolt actuating means extending generally transversely to the plane of said door for moving said bolt as said bolt actuating means is rotating;

an auxiliary lock mounted on said door along said one lateral edge in vertically spaced relation with said first mentioned lock, said auxiliary lock including a bolt movable in a lateral path between a projecting position projecting beyond said one lateral edge and a laterally inner position, said auxiliary lock including second bolt actuating means extending transversely to the plane of said door;

a one piece lock guard including an elongate channel, being U-shaped in section, having a base generally perpendicular to the plane of said door with aperture means therethrough;

bolt plate means received in said aperture means and mounted on said door with the outer face of said bolt plate means being flush with the outer face of said base;

said bolt plate means having additional aperture means therethrough slidably receiving said bolts;

said lock guard including a pair of confronting flange portions, generally parallel to the plane of said door bearing against said inner and outer sides of said door, at least one of said flange portions having aperture means therethrough receiving said bolt actuating means; and a longitudinally extending strike plate portion adapted to be vertically disposed between said door and a door jamb, having aperture means therein for receiving said bolts in said projecting positions, said strike plate portion including a transversely extending door stop flange on the inner end of said strike plate portion extending transversely to the plane of said door in a direction toward said door, and an oppositely directed mounting flange at the outer edge of said plate portion for engaging the outer face of said door jamb;

said door including a recessed portion receiving the base portion of said lock guard such that the laterally outer surface of said base portion is flush with the laterally outer edge portion surface of said door.

* * * * *